US007806292B2

(12) United States Patent
Simkins

(10) Patent No.: US 7,806,292 B2
(45) Date of Patent: Oct. 5, 2010

(54) TOWELETTE DISPENSER

(75) Inventor: Nelson E. Simkins, Rittman, OH (US)

(73) Assignee: Joseph S Kanfer, Richfield, OH (US)

( * ) Notice: Subject to any disclaimer, the term of this patent is extended or adjusted under 35 U.S.C. 154(b) by 779 days.

(21) Appl. No.: 11/701,114

(22) Filed: Feb. 1, 2007

(65) Prior Publication Data

US 2009/0255950 A1 Oct. 15, 2009

Related U.S. Application Data

(63) Continuation-in-part of application No. 11/363,822, filed on Feb. 28, 2006, now Pat. No. 7,556,175.

(51) Int. Cl.
*B65H 1/00* (2006.01)
*B65H 3/00* (2006.01)

(52) U.S. Cl. ..... 221/63; 221/36; 221/33; 221/45; 221/106; 221/222; 221/480; 221/242; 221/588.3; 221/225; 221/39

(58) Field of Classification Search ..... 221/63, 221/36, 33, 45, 46, 106; 222/480; 242/588.3; 225/39
See application file for complete search history.

(56) References Cited

U.S. PATENT DOCUMENTS 3,587,944 A * 6/1971 Pehr ..... 222/450
4,185,754 A * 1/1980 Julius ..... 221/63
4,337,876 A * 7/1982 Thompson ..... 221/36
4,526,291 A * 7/1985 Margulies ..... 221/63
4,535,912 A * 8/1985 Bonk ..... 221/46
6,158,614 A * 12/2000 Haines et al. ..... 221/63
6,182,858 B1 * 2/2001 Hartog ..... 221/63
6,360,909 B1 * 3/2002 Bridge ..... 220/258.2
6,786,447 B2 * 9/2004 Geib et al. ..... 242/588.3
7,255,254 B2 * 8/2007 Tan ..... 225/39
7,354,598 B2 * 4/2008 Masting ..... 424/443
2007/0210098 A1 * 9/2007 Evans et al. ..... 221/63

* cited by examiner

*Primary Examiner*—Gene O. Crawford
*Assistant Examiner*—Rakesh Kumar
(74) *Attorney, Agent, or Firm*—Renner, Kenner, Greive, Bobak, Taylor & Weber

(57) ABSTRACT

A towelette dispenser is provided with an integrally molded lid. The lid has a central aperture for allowing access to a roll of towelettes maintained within a tub receiving the lid therein. The separation bar bridges the aperture, and provides a rip fence in the form of a fingered thimble that is angled with respect to the lid as a whole. The thimble is offset near one edge of the annular opening so that a user may access the back side thereof to thread an edge of the leading towelette through the thimble without having to remove the lid from the tub. A well is provided in the smaller portion of the aperture and a cap for the lid is provided with a stuffer tab to urge the leading edge of the next towelette into the well when the cap is closed. Barrier caps are also provided to seal the interior of the tub during shipment and storage before the first use of the towelette dispenser. The barrier caps have removable portions that permit access to the interior of the lid and are removable without having to remove the lid from the tub.

3 Claims, 3 Drawing Sheets

TOWELETTE DISPENSER

RELATED APPLICATIONS

This application is a continuation-in-part of U.S. patent application Ser. No. 11/363,822, filed on Feb. 28, 2006 now U.S. Pat. No. 7,556,175.

TECHNICAL FIELD

The invention herein resides in the art of dispensing devices and, more particularly, to devices adapted for maintaining and allowing for the separate dispensing of interconnected towelettes or "wipes." Specifically, the invention relates to a novel integrally configured dispensing lid and cap that allows for ease of threading the leading towelette into the separating mechanism, while accommodating secured closure of the cap upon the towelette container.

BACKGROUND ART

It has become increasingly popular to employ towelettes or "wipes" in various industries and in everyday life. Typically, a towelette or wipe is a fibrous piece of material that is impregnated or saturated with a cleanser or treatment, such as disinfectant, detergent, solvent, wax or polish, by way of example only. While such towelettes have previously been maintained in containers in a fan fold arrangement, where the towelettes are separate and independent of each other, the most common and utilitarian type presently employed finds the towelettes forming a continuous web and being separable from each other by means of perforations or the like. Typically, the towelettes are maintained upon a continuous roll, although the invention contemplates random mass storage and maintenance of the same. In such arrangements, the tub or container maintaining the towelettes has generally been provided with a lid having a rip fence or other separating mechanism to allow for the separation of the leading towelette from the remaining towelettes on the roll or within the grouping.

Several problems have characterized the prior art devices. Most formidable is the mechanism by which the leading edge of the first towelette is threaded into the rip fence, such that the remainder of the web may be progressively pulled therethrough and the towelettes individually separated. Prior devices have typically required removal of the lid from the tub or container of towelettes, the threading of the leading towelette through the rip fence, and the replacement of the lid upon the tub. Such a process has typically been found to be complex and given to error and frustration by the user. Moreover, the prior art towelette dispensers have not been given to a simplicity in design that provides a mechanism that ensures that the leading edge of the next towelette to be dispensed is stuffed within the container or tub and not in the way of the lid or cap when it is to be closed and sealed. The prior art dispensers have also had dispensing lids that are complex and costly, often being of multiple pieces requiring seam welding and the like to configure the pieces into an operative unit. This can be improved upon to the advantage of the art.

Additionally, the common dispensing lids often fit over seals or barrier caps that prevent the evaporation of any solution within the towelettes and the tub during transportation and initial storage before the first use. The lids must be removed to access the barrier cap for removal. Thus the connection between the lid and the tub must be aggressive enough to hold the lid on the tub, but weak enough so as to allow the removal of the lid from the tub. This can result in making the lid connect to the tub is such a way that the cleanser or other treatment can evaporate and exit the tub through the connection between the lid and tub, decreasing the practical storage length for the tub of towelettes. Also, having to remove the lid to remove the barrier cap is an additional step required to begin using the towelettes, and requires that the tub be opened and the towelettes exposed to evaporation for the time during which the lid and barrier cap are removed and before the lid is again applied and closed.

There remains a need in the art for a simple, cost effective, and reliable lid for a towelette dispenser that allows for ease of use and ease of set-up. There also remains a need for better sealing methods for towelette dispensers for transportation and initial storage before the first use.

DISCLOSURE OF THE INVENTION

In light of the foregoing, it is a first aspect of the invention to provide a towelette dispenser that has a lid that is of a totally integral design.

Another aspect of the invention is the provision of a towelette dispenser having a lid that accommodates ease of threading of the leading edge of the first towelette to be dispensed through a rip fence configured as a thimble.

Yet a further aspect of the invention is the provision of a towelette dispenser having a lid with a cap that is configured to push or stuff the leading edge of the next towelette to be dispensed into the container and to prevent it from interfering with the closing and sealing thereof.

Yet a further aspect of the invention is the provision of a towelette dispenser that is of a simplistic design, substantially reducing costs, while significantly increasing ease of use.

It is yet another aspect of the invention to provide improved barrier caps for sealing the towelette dispenser for transportation and initial storage before the first use.

Certain aspects of the invention are achieved by a towelette dispenser and barrier cap combination. This combination includes a tub having an open end and receiving and maintaining a bulk supply of towelettes. A lid is received by an open end of the tub, and includes a base portion having a central aperture defined by a circumferential edge radially inset from the open end of the tub. A barrier cap is secured to the open end of the tub at a peripheral edge of the barrier cap. The barrier cap includes a tear boundary inset from the peripheral edge of the barrier cap, and a removable access member removably secured to the barrier cap at the tear boundary.

The tear boundary preferably substantially aligns with the lid to fall within the central aperture defined by the circumferential edge on the lid such that the removable access member can be accessed through the central aperture without necessitating the removal of the lid to access the barrier cap.

BRIEF DESCRIPTION OF DRAWING

For a complete understanding of the various aspects, strictures and processes of the invention, reference should be made to the following detailed description and accompanying drawing wherein.

BEST MODE FOR CARRYING OUT THE INVENTION

Figure 1:
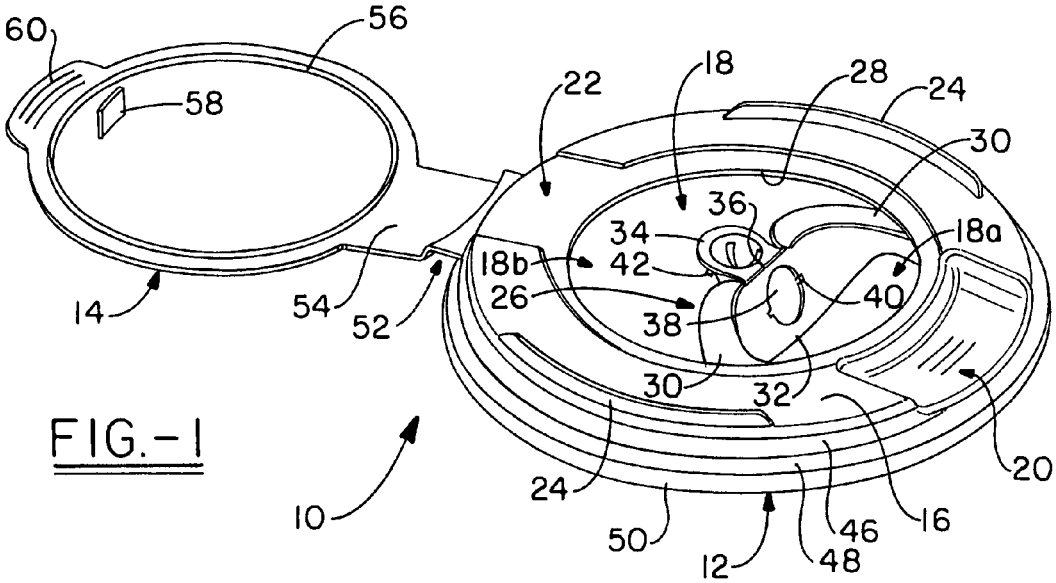
FIG. 1 is a perspective view of a dispensing lid made in accordance with the invention.

Referring now to the drawings, it can be seen that a dispensing lid made in accordance with the invention is designated generally by the numeral 10. As will be appreciated herein, a benefit of the dispensing lid 10 is the fact that it can be molded as a single piece of a suitable plastic or elastomeric material. The dispensing lid 10 includes a base portion 12 and a cap portion 14.

The base portion 12 is characterized by a top annular planar surface 16 having a central aperture 18 therein. About the top periphery of the base portion 12 is a major recessed area 20 to accommodate the user's finger for opening the dispensing lid 10 in a manner to be discussed later herein. Also characterizing the outer peripheral area of the base portion 10 is a minor recessed area 22 adapted to accommodate a portion of the cap 14 when the cap 14 is closed over the aperture 18, in a manner which will become apparent later. A rib or ribs 24 extend upwardly from the top annular planar surface 16 about an outer periphery thereof and are employed to accommodate receipt and stacking of tubs or buckets of the towelettes to be dispensed, in a manner which will be readily appreciated by those skilled in the art.

The base portion 12 includes a separation bar 26 that is connected to and extends inwardly from the inner circumferential edge 28 of the aperture 18. The separation bar 26 includes a pair of legs 30 that extend substantially radially inward to a center support plate 32. The separation bar 26 is positioned to divide the aperture 18 into a smaller fore portion 18*a* and a substantially larger aft portion 18*b*. The purpose and benefits of these distinct and particularly sized portions of the aperture 18 will become apparent herein.

The center support plate 32 carries a rip fence in the form of a thimble 34, of substantially conical shape. The thimble 34 is connected by flexible or "living" hinge 36 to the center support plate 32. As is best shown in FIG. 1, the plate 32 is characterized by the presence of a hole 38 passing therethrough, having slots or notches 40 on diametrically opposed sides thereof. The slots or notches 40 are adapted to receive tabs, latches or the like 42 that are an integral portion of thimble 34. Accordingly, when the thimble 34 is rotated about the hinge 36 such that is passes through the hole 38 of the plate 32, the tabs or latches 42 engage in the slots or notches 40 to securely maintain the thimble 34 in the position best shown in FIG. 2.

It will be appreciated that the thimble 34 is characterized by a plurality of fingers 44 that are defined by through-slotting of the conical thimble 34. As shown, four or more fingers 44 are desired. Being made of plastic, the fingers 44 are biased inwardly by the conical nature of the thimble 34, but can flex outwardly as needed during use.

As shown in FIG. 1, the base portion 12 is characterized by circumferential flanges 46, 48, separated by a lip 50. The circumferential flange 46 is radiused at its top edge into the top annular planar surface 16. A circumferential lip 50 extends downwardly from and normal to the circumferential flange 48.

With continued reference to FIG. 1, it can be seen that the cap portion 14 is secured by means of an integral hinge, web or member 52 to the base portion 16. Extending from the hinge 52 is a neck 54 that is integral with and connects to the substantially circular portion of the cap 14. An annular ring 56 extends from the cap portion 14 and is sized and configured to be sealingly received by the circumferential edge 28 of the aperture 18 when the lid 14 is pivoted about the hinge 52 when closure is desired.

A stuffer tab or member 58 extends from the cap portion 14 at such a point in location as to be received by the fore aperture portion 18*a* when the cap portion 14 is closed upon the base portion 12. Finally, a lift tab 60 extends from a peripheral edge of the cap portion 14 and is adapted for receipt by the major recess 20 upon closure. The recess 20 allows users to place their fingertips thereunder for lifting engagement with the tab 60. Finally, it will be appreciated that the minor recessed area 22 is positioned and configured to receive the neck portion 54 upon such closure.

Figure 2:
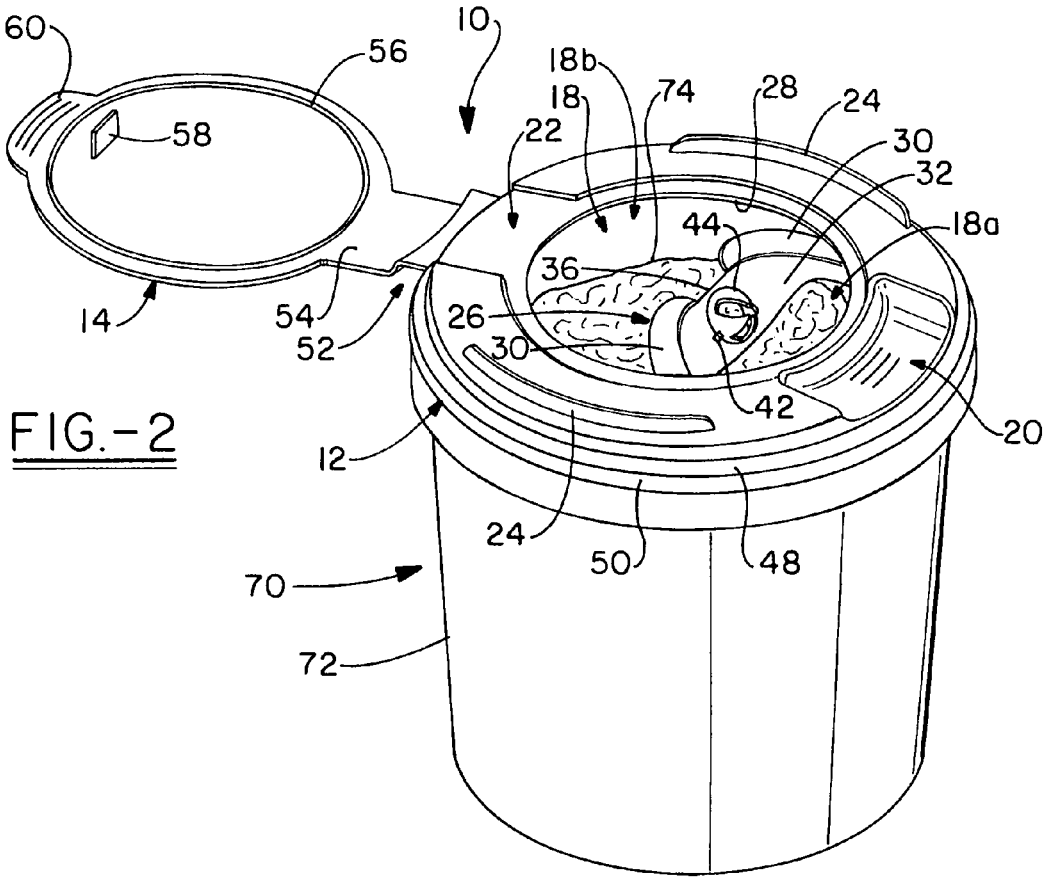
FIG. 2 is a perspective view of a tub of towelettes employing the lid of FIG. 1.

As shown in FIG. 2, a wipes or towelette dispenser employing the cap 10 is designated generally by the numeral 70. A tub 72 receives the cap 10, with the lip 50 passing over the top outside rim of the tub 72 and with the underside of the circumferential flange 48 resting thereon.

The tub 72 is filled with a plurality of towelettes 74, typically maintained in a roll, but which also may be simply randomly placed therein in bulk. In any event, the invention herein is particularly usable with towelettes that comprise a single web of interconnected towelettes that are defined by perforations therebetween, which are provided for ease of separation.

According to the concept of the invention, the aft portion 18*b* of the aperture 18 is sized sufficiently for the user's hand to reach the lead towelette in the bulk of towelettes 74 maintained therein. When maintained in the roll, the lead towelette comes from the center of the roll. The leading edge of this first to be dispensed towelette may then be threaded through the fingers 44 of the thimble 34. The fingers 44 are sized and configured such as to provide a grip on the towelettes being dispensed, with the grip being sufficient that as the lead towel is pulled through the aperture defined by the fingers, the drag on the towelette is greater than the force required for separation at the perforations connecting the towelettes. In use, as the area of perforation is passed through the thimble 34, the perforations begin to separate as the leading edge of the next towel emerges from the fingers of the thimble 34, such that total separation of the first towelette is achieved when approximately an inch or so of the leading edge of the subsequent towelette has passed through the thimble 34. Accordingly, the leading edge of the next-to-be-dispensed towelette is exposed for ready access by the user.

To ensure that the leading edge of the next towelette does not interfere with sealing of the cap portion 14 over the aperture 18 of the base portion 12, the cap portion 14 is provided with a stuffer tab 58, which is so positioned as to be received by the fore portion 18*a* of the aperture 18 upon closure of the cap 14. This stuffer tab 18 pushes the leading edge of the towelette into the well of the fore portion 18*a* of the aperture 18, and out of the way of any sealing engagement between the cap 14 and base portion 12.

As is apparent from the drawings, the center support plate 32 is angled with respect to the top annular plate surface 16. This angle is for several important reasons. First, by being somewhat vertical, it is much easier for the user to secure the leading edge of the first towelette and thread it through the thimble 34, than if the thimble 34 were substantially vertical.

Accordingly, ease of threading of the towel web is attained, without having to remove the dispensing lid 10 from the tub 72.

Additionally, the angle of the thimble 34 allows for ease of withdrawal of the towelette therethrough, while also accommodating an upward pulling motion on the towelette once the perforation has passed through the thimble, if it is not apparent that such separation is proceeding satisfactorily. This upward pulling increases the effective force of at least certain of the teeth or fingers 44 upon the subsequent towelette, and allows for more separating force on the perforations, without further extension of the subsequent towelette through the thimble 34.

While the concept of the invention is adaptable to various sizes of tubs, containers and lids, it is contemplated that the lid 14 will typically have a diameter on the order of 6 inches, with the aperture 18 having a diameter of on the order of 4 inches. However, this sizing can certainly vary as will be appreciated by those skilled in the art. In any event, it is preferred that the separation bar 26 be so positioned that the fore portion 18*a* of the aperture 18 be 15-30% of the total aperture 18, with the remaining aft portion 18*b*, which is preferably sized to accommodate a user's fingers, is on the order of 70-85% of the aperture 18.

It has similarly been found that the thimble 34, which is preferably angled with respect to the horizontal, rather than having a base parallel thereto as was common in the art, be angled upwardly on the order of 15-30° with respect to the horizontal or the top annular planar surface 16. As presented above, this accommodates both threading and separating of the towelettes.

Figure 3:
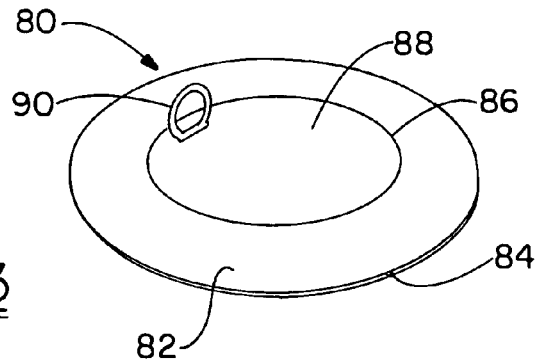
FIG. 3 is a general perspective view of a basic barrier cap for closing off a tub of towelettes in accordance with this invention.

When the towelettes are saturated with a cleanser or other treatment, it is common to seal the top of the tubs or buckets in which they are provided. Herein, a special barrier cap is provided and specifically adapted to the type of dispensing lid 10 just disclosed. A simple form of this special barrier cap is shown in FIG. 3 and is designated by the numeral 80. The barrier cap 80 is sealed to the tub 72 at its peripheral edge 84, which mates up to the peripheral edge 75 of the open end of tub 72. A tear boundary 86 is inset from peripheral edge 84, preferably very near or more preferably inset from the position of circumferential edge 28 of the dispensing lid 10, when the lid 10 is placed over the barrier cap 80 and tub 72.

A removable access member 88 is secured to the barrier cap 80 at the tear boundary 86. As manufactured and shipped, the removable access member 88 is sealed at the tear boundary 86 such that it, together with the seal between the peripheral edges 84, 75, keeps the interior of the tub 72 sealed to prevent the evaporation or other means for escape of any cleaner or other treatment that might be impregnated in the towelettes and/or present in the tub 72. The removable access member 88 is selectively removed, thereby providing access to the towelettes for use. In the embodiment shown in FIG. 3, a pull ring 90 is provided that, when pulled, causes the removable access member 88 to tear away from the annular portion 82 at the tear boundary 86. Pull ring 90 is preferably integral with removable access member 88 such that they remain secured to each other after their removal.

Figure 4:
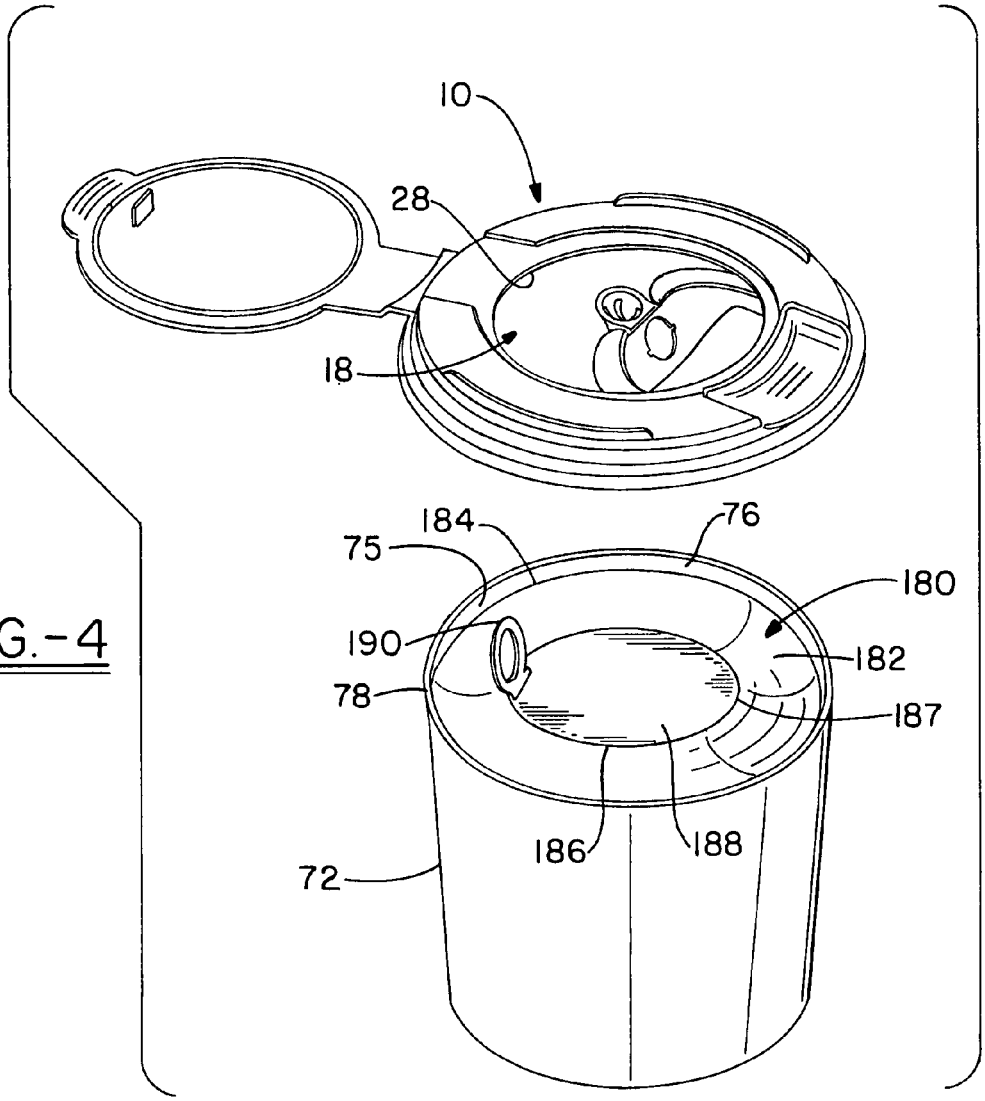
FIG. 4 is an assembly view of a second embodiment of a barrier cap and how it fits within the tub of towelettes environment.

In another embodiment shown in FIG. 4, a barrier cap 180 includes an annular portion 182, extending from the peripheral edge 184 that is press fit to seal to the inner surface 76 of the sidewall 78 of the tub 72. The peripheral edges may also be adhered to surface 76 or otherwise secured. Although it can be planar and still serve a desired function, the annular portion 182 is preferably curved, sloping first downwardly for a small radial distance from the peripheral edge 184, and then upwardly to raised edge 187 of barrier cap 180. The tear boundary 186 in this embodiment is provided at raised edge 187 as a weakened portion of barrier cap 180 that is readily separated from the annular portion 182 secured to the tub 72. The preferred downward slope extending radially from the peripheral edge 184 aids in the press fit securing of the barrier cap 180 to the sidewall 78 of tub 72. More particularly, the sidewall 78 tapers from a larger opening to a smaller base, with the larger opening permitting the barrier cap 180 to enter the interior of tub 72, until the contact between the peripheral edge 184 and the inner surface 76 of sidewall 78 begins to resist the insertion of the barrier cap 180. Additional pressure in the downward direction will adequately seal the barrier cap 180 to the sidewall 78, particularly if the sidewall is made of a resilient material, such as a plastic material, which will give to the pressure, and exert a squeezing force against the peripheral edge 184. The preferred sloped surface of the annular portion 182 can also advantageously be practiced to place the tear boundary 186 closer to the circumferential edge 28 of the dispensing lid 10, when the lid 10 is placed over barrier cap 180. The advantages of this structure will become apparent when described in more detail below.

Figure 5:
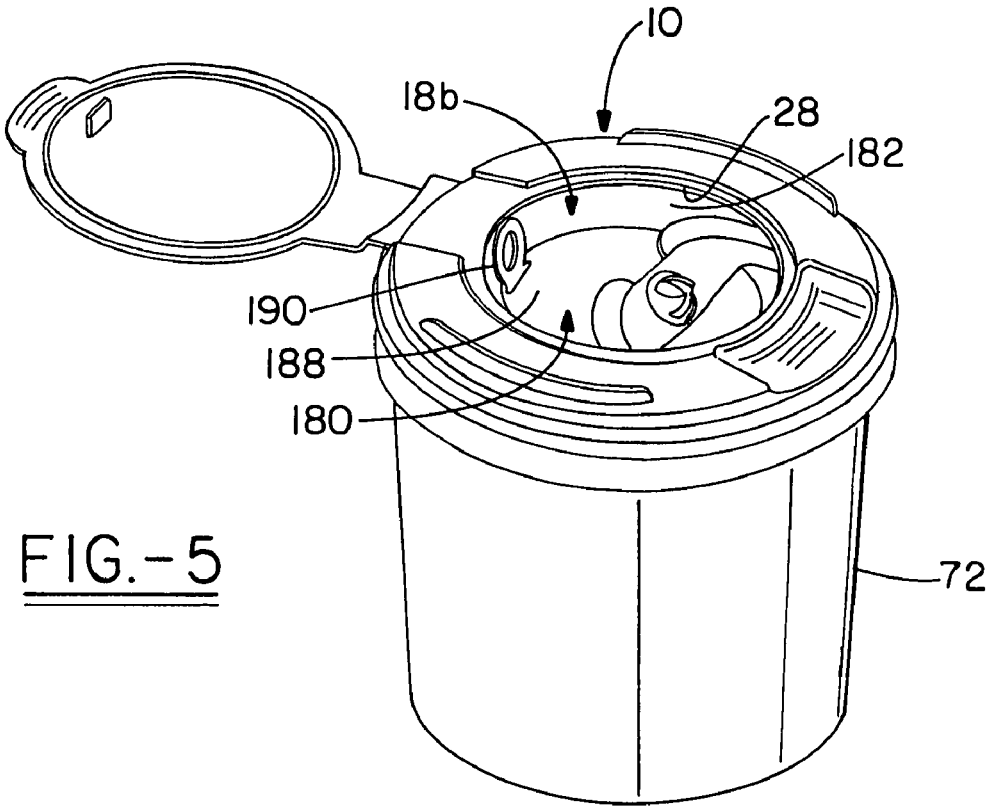
FIG. 5 shows the assembled tub, barrier cap and lid of FIG. 4.

When the barrier cap 180 is secured to the tub 72, and dispensing lid 10 is secured thereover, as shown in FIG. 5, the sizing of the annular portion 182 places the pull ring 190 closer to, and preferably within, the radial dimensions of the circumferential edge 28. The sloped surface of the annular portion 182 also places the pull ring 190 closer to the aperture 18 in the dispensing lid 10. In this way, the pull ring 190 is readily grasped and the removable access member 188 is readily removed through the larger aft portion 18*b* of the aperture 18, without requiring removal of dispensing lid 10. When the removable access member 188 is removed, the towelette dispenser will appear substantially as in FIG. 2, with access provided to the roll of towelettes as already disclosed.

Figure 6:
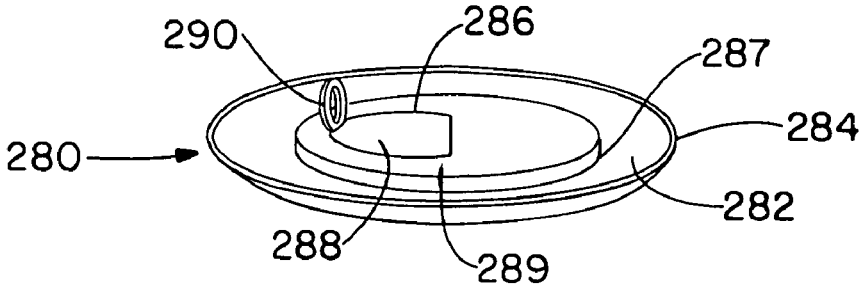
FIG. 6 is a general perspective view of another embodiment for a barrier cap in accordance with this invention.

Finally, with reference to FIG. 6, yet another embodiment for a useful barrier cap is disclosed. A barrier cap 280 includes an annular portion 282 sloped from a peripheral edge 284 to a raised edge 287, substantially as in the embodiment of FIG. 4, but this raised edge 287 defines a plateau portion 289 with a tear boundary 286 being provided within the area defined by the plateau portion 289. The annular portion 282 and the plateau portion 289 are integral and provide a strong transition at their mating boundary, with the weakened portion being provided at tear boundary 286 defining a removable access member 288 that is smaller than the plateau portion 289. As with other embodiments, the tear boundary 286 is preferably provided as a weakened portion of the barrier cap 280 that is readily separated from the remainder of the plateau portion 289 by pulling on a pull ring 290 that is integral with the removable access member 288. This particular embodiment focuses on providing a removable access member 288 that is sized to align with the larger aft portion 18*b* of the aperture 18 of dispensing lid 10.

Although pull rings and tear boundaries have been described for forming the removable access members herein, it will be appreciated that these structures and means for providing a removable access member are preferred only. More common foil members could be heat sealed to tear boundaries or film members could be sealed thereto as known in the art. Such foil or film members could include tabs or pull rings extending therefrom for the same purpose as the pull rings disclosed.

The barrier caps are preferably made from a thermoplastic or other suitable polymer/plastic material. Indeed suitable materials are know in the art and are not the focus of this invention. While certain concepts for sealing a barrier cap to a tub have been provided herein, it should be understood that this invention is not necessarily limited to or by any such concept. Any generally known technique could be employed to seal the barrier cap to the tub. It should be appreciated as well that the tubs could be formed with the non-removable portions of the barrier caps being integral to the tubs rather than being sealed to either an upper peripheral edge thereof or an inner surface of a sidewall.

Thus it can be seen that the various aspects of the invention have been satisfied by the stricture presented and described herein. While in accordance with the patent statutes only the best known and preferred embodiment of the invention has been presented and described in detail, the invention is not limited thereto or thereby, but is defined by the following claims.

What is claimed is:

1. A towelette dispenser comprising:

a container serving to retain a plurality of towelettes;

a lid on said container, said lid including:

a central aperture;

a separation bar bridging said central aperture and dividing said central aperture into fore and aft sections, said fore section of said central aperture providing said fore well, and an aperture in said separation bar for feeding a lead edge of a lead wipe of said plurality of wipes from inside said container to a position accessible outside of said container; and a fore well adjacent said aperture and providing an opening into said container;

a cap selectively moved between a open position and a closed position relative to said lid; and a stuffer tab on said cap, said stuffer tab received into said fore well in said lid when said cap is moved to said closed position, said stuffer tab serving to urge into said fore well a lead edge of a lead wipe fed through said aperture.

2. A towelette dispenser comprising:

a container serving to retain a plurality of towelettes;

a lid on said container, said lid including:

an aperture for feeding a lead edge of a lead wipe of said plurality of wipes from inside said container to a position accessible outside of said container; and a fore well adjacent said aperture;

a cap selectively moved between a open position and a closed position relative to said lid; and a stuffer tab on said cap, said stuffer tab received into said fore well in said lid when said cap is moved to said closed position, said stuffer tab serving to urge into said fore well a lead edge of a lead wipe fed through said aperture.

3. The towelette dispenser of claim 2, wherein said fore well provides an opening into said container.

* * * * *